US009157341B2

(12) United States Patent
Brodbeck

(10) Patent No.: US 9,157,341 B2
(45) Date of Patent: Oct. 13, 2015

(54) CAMSHAFT ASSEMBLY AND INTERMEDIATE CAM PHASING POSITION

(71) Applicant: Mahle International GmbH, Stuttgart (DE)

(72) Inventor: Luke Brodbeck, Brighton, MI (US)

(73) Assignee: Mahle International GmbH (DE)

( * ) Notice: Subject to any disclaimer, the term of this patent is extended or adjusted under 35 U.S.C. 154(b) by 8 days.

(21) Appl. No.: 14/026,522

(22) Filed: Sep. 13, 2013

(65) Prior Publication Data

US 2014/0076255 A1 Mar. 20, 2014

Related U.S. Application Data

(60) Provisional application No. 61/701,146, filed on Sep. 14, 2012.

(51) Int. Cl.

| | |
|---|---|
| ***F01M 1/06*** | (2006.01) |
| ***F01L 1/344*** | (2006.01) |
| ***F01L 1/047*** | (2006.01) |
| *F01L 1/46* | (2006.01) |

(52) U.S. Cl.

CPC ..... *F01L 1/344* (2013.01); *F01L 1/047* (2013.01); *F01L 1/46* (2013.01); *F01L 2001/0473* (2013.01); *F01L 2001/34423* (2013.01); *F01L 2001/34453* (2013.01)

(58) Field of Classification Search

CPC ..... F01L 1/047; F01L 1/344; F01L 1/46
USPC ..... 123/90.6, 90.33, 90.34
See application file for complete search history.

(56) References Cited

U.S. PATENT DOCUMENTS

2005/0109298 A1 5/2005 Bolz et al.
2007/0272184 A1 11/2007 Rommel et al.

FOREIGN PATENT DOCUMENTS

DE 102006013829 A1 9/2007

*Primary Examiner* — Ching Chang
(74) *Attorney, Agent, or Firm* — Fishman Stewart Yamaguchi PLLC

(57) ABSTRACT

A camshaft assembly comprising an outer shaft, an inner shaft received within the outer shaft, and a bushing disposed about the inner shaft, the bushing having an outer surface defining at least one longitudinal groove extending at least partially along a length of the bushing, wherein the longitudinal groove cooperates with the outer shaft to define a fluid passage.

19 Claims, 6 Drawing Sheets

CAMSHAFT ASSEMBLY AND INTERMEDIATE CAM PHASING POSITION

CROSS-REFERENCE TO RELATED APPLICATION

This application claims priority to U.S. Provisional Application Ser. No. 61/701,146, filed on Sep. 14, 2012, the contents of which are hereby expressly incorporated by reference in their entirety.

BACKGROUND

Camshaft phasing mechanisms allow selective adjustment of valve timing for internal combustion engines by selectively advancing or retarding the positions at least some of the lobes on a camshaft, thereby allowing associated valve movements to occur either earlier or later in the combustion cycle. For example, engines may operate more efficiently or effectively during one set of operating conditions when the valve timing is advanced, i.e., such that a valve(s) movement occurs earlier during the combustion cycle. Additionally, it may be desirable during a second set of operating conditions to retard the valve timing, i.e., such that a valve(s) movement occurs later during the combustion cycle. Adjusting the relative positions of at least some of the lobes on a camshaft allows internal combustion engines to operate with improved fuel economy, torque, and emissions.

Camshaft phasing mechanisms typically may be selectively positioned between at least two different settings ranging from fully advanced to fully retarded positions. Some systems employ oil pressure resulting from engine operation to selectively actuate phasing mechanisms during engine operation. These systems rely upon oil pressure to maintain a desired cam position and the resulting timing of a given valve. As a result, when engine operation ceases and oil pressure is lost the cam phasing mechanism may default to a position at either extreme of the phasing range, i.e., a fully advanced or fully retarded position. When the engine is subsequently started again, the valve will necessarily be in the default position for at least a short period of time, e.g., until engine oil pressure rises sufficiently to allow use of the phasing system. However, this may result in non-ideal engine start conditions. More specifically, at engine startup and especially during a cold temperature startup, it may be more desirable to have the camshaft positioned at a position in between the fully advanced and fully retarded position. There have been subsequent attempts at achieving an intermediate position, however proposed systems are complex and there is still a need for a cam phasing system that offers a sufficient degree of control over cam phasing when oil pressure may not be available, e.g., during engine startup conditions. Moreover, camshafts used in adjustable valve phasing systems that are hydraulically actuated may require one or more fluid passages in order to provide hydraulic pressure to selectively advance or retard timing of a cam lobe. Known examples of such camshafts rely upon fluid passages that are machined in the shaft or another part of the cam phaser. Forming such passages in these components can be costly and time-consuming.

Accordingly, there is a need for a camshaft assembly for a variable valve timing system that addresses the above problems.

DETAILED DESCRIPTION

Figure 1A:
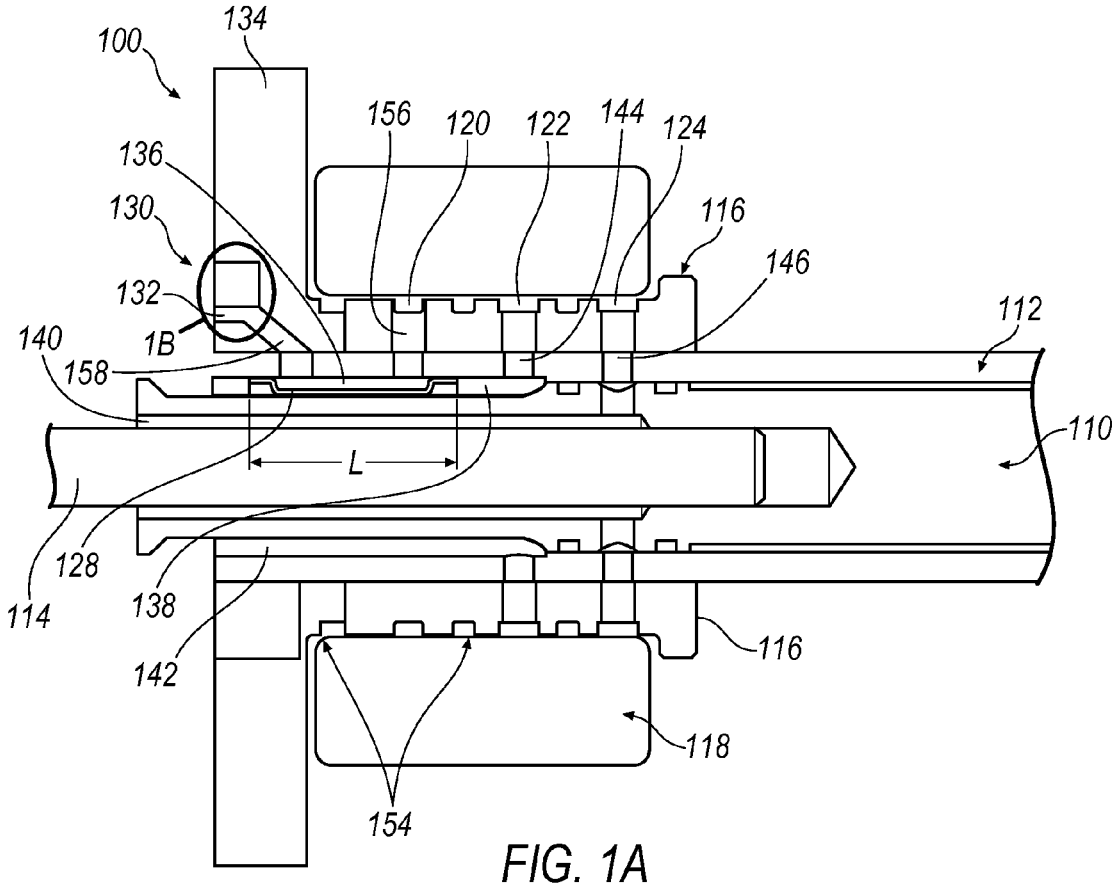
FIG. 1A illustrates a partial section view of a first exemplary illustration of an exemplary camshaft assembly, with a bushing defining a portion of a fluid passage.

Referring now to the discussion that follows and the drawings, illustrative approaches to the disclosed systems and methods are described in detail. Although the drawings represent some possible approaches, the drawings are not necessarily to scale and certain features may be exaggerated, removed, or partially sectioned to better illustrate and explain the present disclosure. Further, the descriptions set forth herein are not intended to be exhaustive, otherwise limit, or restrict the claims to the precise forms and configurations shown in the drawings and disclosed in the following detailed description.

Various exemplary illustrations are provided herein of a camshaft and valvetrain that may allow for variable phasing of at least one cam lobe of a camshaft assembly. More specifically, the cam lobe may be in communication with one or more intake or exhaust valves, and may thereby selectively actuate the valve(s) via rotation of the camshaft. The cam lobe may be phased between a fully advanced position and a fully retarded position. Moreover, a locking pin may be provided that selectively locks the cam lobe in an intermediate position between the fully advanced and fully retarded positions.

Exemplary systems may include a camshaft assembly (e.g., a "CAM-IN-CAM" camshaft) including an inner camshaft and an outer camshaft. The inner camshaft may define one or more camshaft lobes that may be selectively fixed to the inner camshaft to allow the lobes to be "phased," i.e., adjusted rotationally with respect to the inner camshaft. The outer camshaft may define one or more lobes that are fixed with respect to the outer camshaft.

The camshaft assembly may include a separate lobe, which may itself be fixed to the inner or outer camshaft, which actuates a cam follower. The cam follower in turn may actuate a valve directly. Alternatively, the cam follower may actuate a hydraulic valve actuation system, e.g., a "UniAir" system. A hydraulic valve actuation system may selective actuate valves on the same cylinder. Moreover, the hydraulic valve actuation system may adjust duration and/or lift of the valves actuated by the hydraulic valve actuation system. In one exemplary illustration, the hydraulic valve actuation system employs a reservoir which selectively opens and closes a solenoid to open and close the actuated valves.

Figure 2:
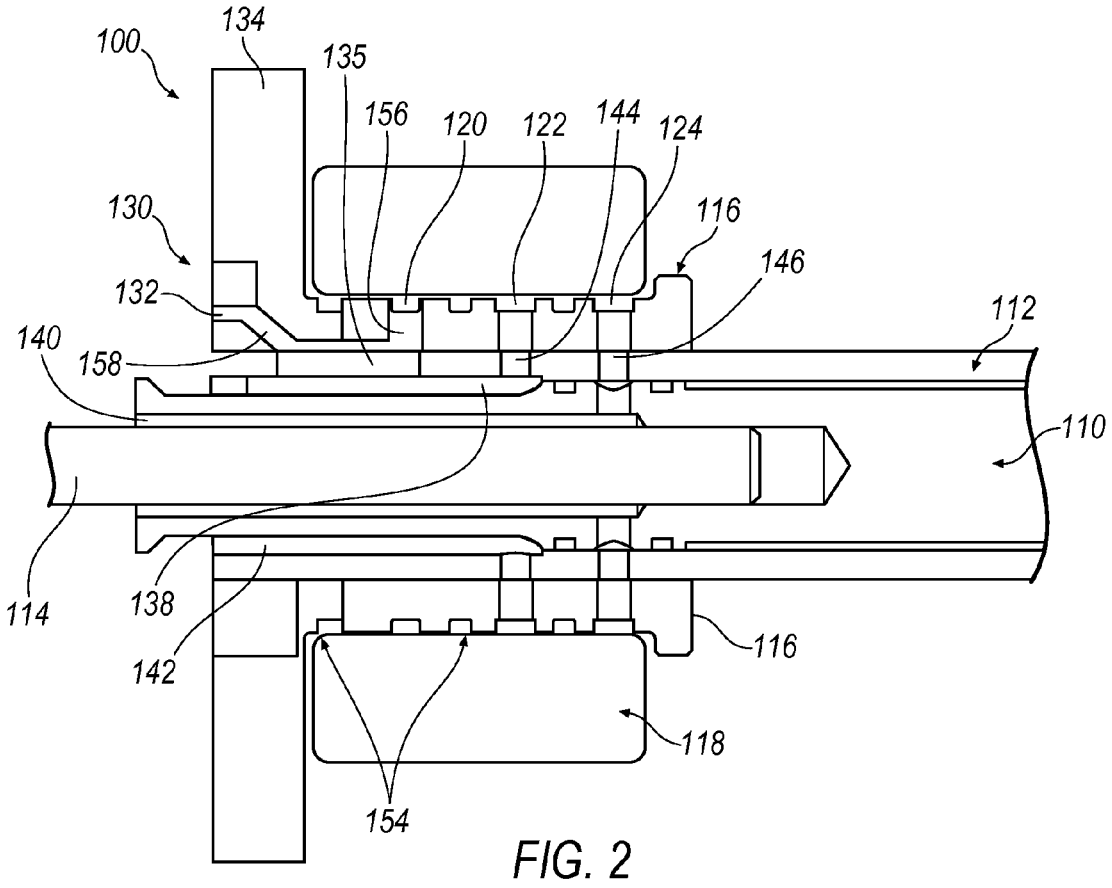
FIG. 2 illustrates a partial section view of a second example of a camshaft assembly, with an alternative fluid passage defined within the camshaft assembly.

FIGS. 1A and 2 illustrate alternative examples of a camshaft assembly. The camshaft assembly 100 may include an inner camshaft 110 and an outer camshaft 112. Camshaft assembly 100 may define two hydraulic passages 138, 140 for respectively selectively advancing and retarding the timing of at least one cam lobe (not shown) associated with camshaft assembly 100. A locking pin 130 is provided that is configured to selectively lock outer camshaft 112 to inner camshaft 110 for rotation therewith. A third hydraulic passage extends through camshaft assembly 100 to a reservoir 132 adjacent locking pin 130. The third hydraulic passage is configured to selectively activate locking pin 130 in a desired position.

Camshaft assembly 100 may include a center bolt 114 extending longitudinally through a portion of inner camshaft 110. An annular cavity 142 is defined between longitudinal portions of inner shaft 110 and outer shaft 112. A journal bearing 116 may selectively surround and rotatably support a longitudinal portion of outer camshaft 112. A cylinder head assembly 118 may abut journal bearing 116. Cylinder head assembly 118 may define a series of hydraulic openings 120, 122, 124 which extend through journal bearing 116 and outer shaft 112.

Both inner shaft 110 and outer shaft 112 of camshaft assembly 100 may each define one or more camshaft lobes (not shown). The lobes selectively actuate the engine valves (not shown) via rotation of inner shaft 110 and outer shaft 112. The lobes defined by inner camshaft 110 may be selectively fixed to inner camshaft 110 to allow lobes to be "phased," i.e., adjusted rotationally with respect to outer camshaft 110. The lobes defined by outer camshaft 112 may be fixed with respect to outer camshaft 112.

Camshaft assembly 100 defines a multiplicity of hydraulic passages. For example, the first hydraulic passage 138 and second hydraulic passage 140 may allow for selectively advancing and retarding the timing of at least one cam lobe associated with camshaft assembly 100. Moreover, a third hydraulic passage, as will be described further below, may allow the selective activation of a locking pin 130 that selectively locks outer camshaft 112 to inner camshaft 110.

The first, second, and third hydraulic passages may define first, second, and third passage inlets 122, 124, 120, respectively. First passage inlet 122 may be fluidly connected to first fluid passage 144 and to first hydraulic passage 138. Second passage inlet 124 may be fluidly connected to second fluid passage 146 and to second hydraulic passage 140. Third passage inlet 120 may be fluidly connected to third fluid passage 156.

The third fluid passage 156 may be in fluid communication with the locking pin 130 to allow selective movement of the locking pin 130. Accordingly, the locking pin 130 may selectively lock the outer camshaft 112 for rotation with the inner camshaft 110. For example, in one exemplary illustration, third passage inlet 120 and third fluid passage 156 may be fluidly connected to the locking pin 130 via a third hydraulic passage 136 that is defined between a bushing 128 and an interior surface of the outer camshaft 112, as shown in FIG. 1A. Alternatively, in another exemplary illustration the third passage inlet 120 and third fluid passage 156 may be fluidly connected with the locking pin 130 via a third hydraulic passage 135 that is defined in part by an outer surface of the outer camshaft 112, as shown in FIG. 2.

Third passage inlet 120 may be disposed nearest an end of camshaft assembly 100. Camshaft assembly 100 may further include a sprocket 134 that selectively receives locking pin 130, with sprocket 134 located at or adjacent the end of camshaft assembly 100. Accordingly, third passage inlet 120 may be positioned closer to sprocket 134 than the first and second passage inlets 122, 124. Sprocket 134 may define, at least in part, the third hydraulic passage.

Figure 3:
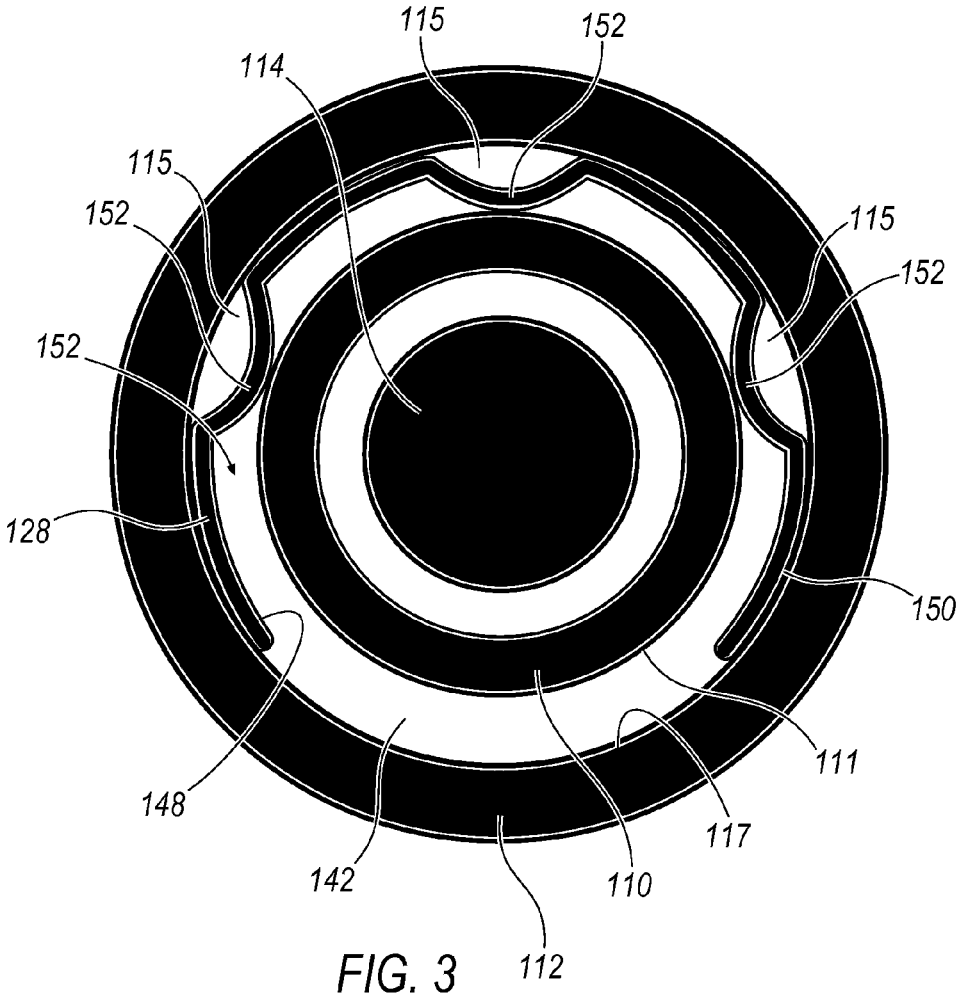
FIG. 3 illustrates a cross-sectional end view of the oil bushing of FIG. 1A disposed in an annular cavity between an inner shaft and an outer shaft of a camshaft assembly.

Inner camshaft 110 and outer camshaft 112 are configured with respect to one another to define annular cavity 142 between longitudinal portions of an outer wall 111 of inner camshaft 110 and an inner wall 117 of outer camshaft 112, as best seen in FIG. 3. Annular cavity 142 thus selectively surrounds a longitudinal portion of inner camshaft 110 when the inner camshaft 110 is received within the outer camshaft 112. Moreover, first hydraulic passage 138 is defined, in part, by the annular cavity 142.

As noted above, as shown in FIG. 1A a bushing 128 may be positioned between longitudinal portions of inner camshaft 110 and outer camshaft 112 within annular cavity 142. When bushing 128 is in place within annular cavity 142, fluid received within the first hydraulic passage 138 from the first fluid passage 144 may travel to an end of the camshaft assembly 100 between an inner surface 148 of bushing 128 (see FIG. 3) and an outer surface 111 of inner shaft 110. The fluid in the third hydraulic passage 136 may thereby be segregated from fluid in the first hydraulic passage 138. The first fluid passage 144 defined by outer shaft 112 and journal bearing 116, and extending from cylinder head assembly 118 to annular cavity 142, is thus fluidly connected to first hydraulic passage 138.

Accordingly, as best seen in FIG. 3, the bushing 128 generally cooperates with the interior surface 117 of the outer camshaft 112 to divide an annular space between the outer surface 111 of the inner camshaft 110 and the inner surface 117 of the outer camshaft 112 into two separate hydraulic passages, i.e., the first hydraulic passage 138 and the third hydraulic passage 136 as shown in FIG. 1A. Moreover, as seen in FIG. 3 the bushing 128 when viewed in section may include a plurality of depressions 115 in an outer surface of the bushing 128 that are spaced about at least a portion of the perimeter of the bushing 128. One or more of the depressions 115 may cooperate with the inner surface 117 of the outer camshaft 112 to form the third hydraulic passage 136. Alternatively, the plurality of depressions 115 may be used to define in part separate hydraulic passages.

Second hydraulic passage 140 may be defined between inner shaft 110 and center bolt 114. Second hydraulic passage 140 is fluidly connected to cylinder head assembly 118 via second fluid passage 146 defined within and extending radially through journal bearing 116 and outer shaft 112. Pressurized oil in one of first or second hydraulic passages 138, 140 may be used to advance the positions of at least some of the lobes of camshaft 100, while pressurized oil in the other hydraulic passage 140, 138 may be used to retard the positions of at least some of the lobes of camshaft 100.

Figure 1B:
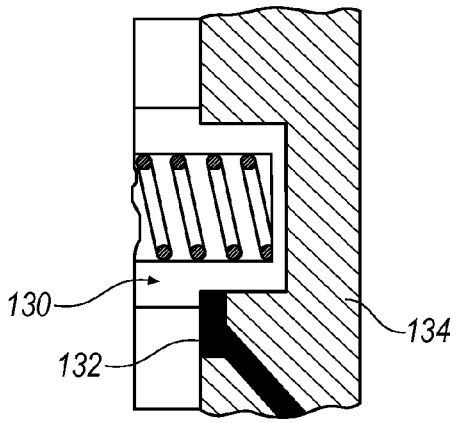
FIG. 1B illustrates a locking pin detail of FIG. 1A.

The third hydraulic passage may extend from cylinder head assembly 118 through journal bearing 116 and to reservoir 132 adjacent locking pin 130. The third hydraulic passage is configured to selectively activate locking pin 130, thereby moving the locking pin 130 into a desired position, as shown in FIG. 1B. Thus, locking pin 130 can lock inner camshaft 110 and outer camshaft 112 together in an intermediate position in relation to one another, between a fully advanced and a fully retarded position. The third hydraulic passage may be further defined in part by seal rings 154 disposed on opposite sides of the locking pin oil passage 120 in journal bearing 116.

In the first example, shown in FIG. 1A, the third hydraulic passage 136 may extend between oil bushing 128 and the inner surface of outer camshaft 112. Oil bushing 128 is positioned between longitudinal portions of inner camshaft 110 and outer camshaft 112 within annular cavity 142. Oil bushing 128 defines at least one groove 152. Groove 152 cooperates with inner surface 117 of outer camshaft 112 to define a portion of third hydraulic oil passage 136. Third fluid passage 156 may be further defined in part by seal rings 154 disposed on opposite sides of third fluid passage 156 in journal bearing 116.

In the second example, as shown in FIG. 2, the third hydraulic passage may extend through the journal bearing 116 which rotatably supports the camshaft assembly. The third hydraulic passage 135 may thus be defined between journal bearing 116 and outer camshaft 112. Third fluid passage 156 may be further defined in part by seal rings 154 disposed on opposite sides of third fluid passage 156 in journal bearing 116.

Locking pin 130 operates hydraulically under engine oil pressure. Consequently, oil generally surrounds locking pin 130. A reservoir 132 is adjacent locking pin, allowing the actuation of locking pin 130. Oil travels to reservoir 132 from cylinder head assembly 118 through the third hydraulic passage.

Locking pin 130 may be used to lock at least one cam lobe of camshaft assembly 100 in any position that may be desired. For example, a cam lobe may be locked in a position that is in between a fully advanced and a fully retarded position. The lock position may be positioned anywhere along the range between the fully advanced and fully retarded positions, including the extreme end positions, i.e., the fully advanced and fully retarded positions. Merely as an example, a single lock position may be provided at the fully advanced position.

Additionally, while a single lock position is illustrated, more than one lock position may be provided. For example, multiple locking pin cavities may be provided, e.g., in sprocket 134, to allow receipt of locking pin 130 therein. Accordingly, more than one lock position is possible, e.g., to facilitate selective locking of the camshafts at a plurality of relative positions during certain operating conditions.

Figure 4:
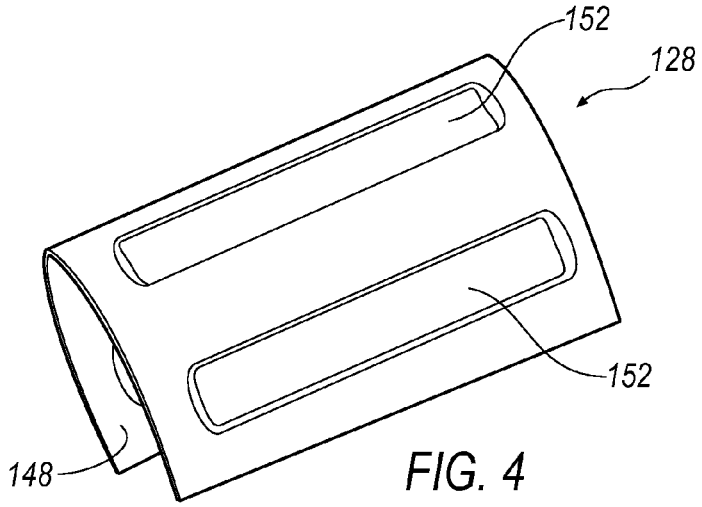
FIG. 4 illustrates a perspective view of the oil bushing of FIG. 1A.

As shown in FIG. 3, oil bushing 128 may be disposed within annular cavity 142 defined between inner camshaft 110 and outer camshaft 112. Oil bushing 128 has an inner surface 148 and an outer surface 150. Bushing 128 may be generally "C"-shaped, and may have at least one longitudinal groove 152 extending generally toward the center of the "C", as illustrated in FIG. 4. Each of the at least one longitudinal grooves 152 has an inner surface which corresponds to inner surface 148 of bushing 128, and an outer surface which corresponds to outer surface 150 of bushing 128. In one example, the groove 152 does not extend to either end of bushing 128, instead ends at a distance from the ends of bushing 128. In other words, in such examples the groove 152 does not extend the entire length of the bushing 128.

Each of the at least one grooves 152 allows reservoir 132 to be fluidly connected to cylinder head assembly 118. Locking pin 130 is thereby activated by oil or hydraulic fluid which fluidly connects reservoir 132 and cylinder head assembly 118 via passage 156 defined within journal bearing 116 and outer shaft 112, through passage 136 defined between outer surface 150 of groove 152 and the inner diameter of outer shaft 112, and a passageway 158 defined in a sprocket 134, and fluidly connected to reservoir 132.

The at least one groove 152 is configured to define a portion of third hydraulic passage 136. When bushing 128 is in place in annular cavity 142, each of the at least one grooves 152 of bushing 128 extends along a longitudinal portion of the outer diameter of inner shaft 110, thereby defining at least one longitudinal cavity between the outer diameter of inner shaft 110 and inner surface 148 of groove 152 in bushing 128, along a length of annular cavity 142.

Oil or hydraulic fluid can also fluidly connect cylinder head assembly 118 with the at least one longitudinal passage 138 defined between the outer diameter of inner shaft 110 and inner surface 148 of bushing 128 through passage 144 defined in journal bearing 116, and annular cavity 142 defined between inner shaft 110 and outer shaft 112.

Bushing 128 has a length, L, and can selectively extend along a longitudinal portion having a length L of inner shaft 110. The thickness of bushing 128 between inner surface 148 and outer surface 150 may be smaller than the radial thickness of the annular cavity 142 between inner shaft 110 and outer shaft 112. When assembled and in place in camshaft assembly 100, the portion of outer surface 150 of bushing 128 that does not define the groove 152 may abut the inner diameter of outer shaft 112. A portion of inner surface 148 of bushing 128 that corresponds with and extends along the length of a portion of each of the at least one grooves 152 may abut the outer diameter of inner shaft 110. Inner surface 148 of the at least one longitudinal groove 152 in bushing 128 may cooperate with the outer surface of inner shaft 110 to define at least one longitudinal passageway between inner shaft 110 and inner surface 148 of bushing 128 through which fluid can flow. Fluid can flow longitudinally between at least a portion of inner surface 148 of bushing 128 and the outer diameter of inner shaft 110.

Oil bushing 128 may be formulated from a material that has enough resilience that it can be pushed onto inner shaft 110, and that allows it to conform to the shape of and fit within annular cavity 142 between inner shaft 110 and outer shaft 112 when the two shafts are assembled together. Merely as examples, the bushing 128 may be formed of a metallic material or a plastic material. In examples where the bushing 128 is formed of a metallic material, the bushing 128 may be stamped from a steel material. In another exemplary illustration, the bushing 128 may be molded from a plastic material. The portion of outer surface 150 of bushing 128 that does not define the at least one groove 152 may abut the inner diameter of outer shaft 110.

At least one seal ring 154 may be disposed on journal bearing 116. The at least one seal ring 154 may extend between a radial surface of journal bearing 116 and cylinder head assembly 118. The at least one seal ring 154 may further define at least a portion of the passage 156.

Figure 5A:
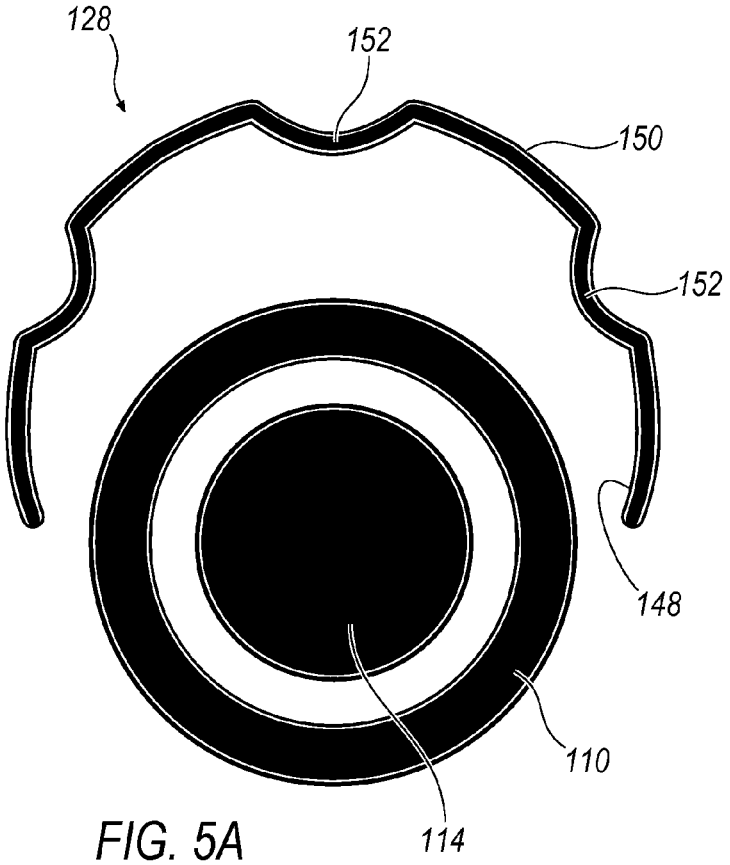
FIG. 5A illustrates the bushing of FIG. 1A to be installed on the inner shaft of a camshaft assembly.
Figure 5B:
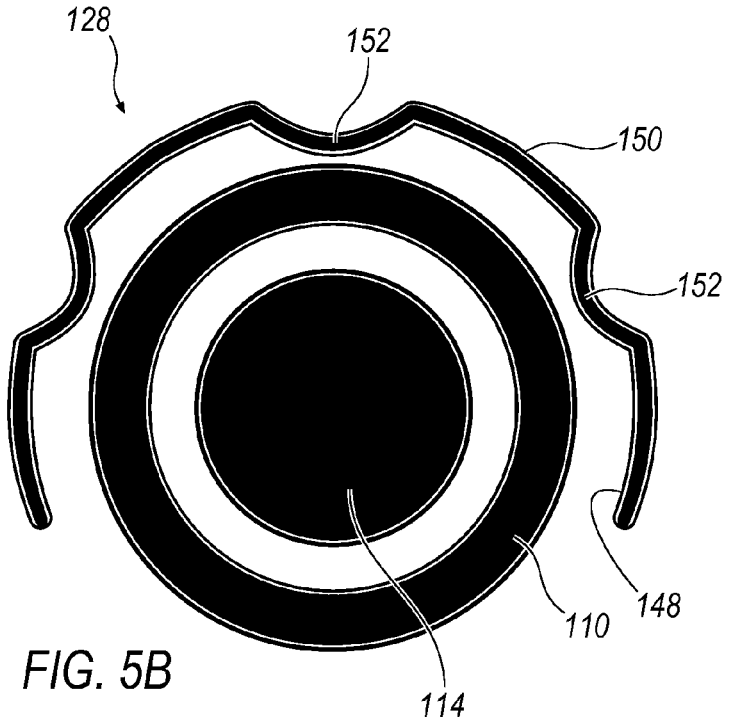
FIG. 5B illustrates the bushing of FIG. 1A in place on the inner shaft of a camshaft assembly.

To assemble oil bushing 128 on camshaft assembly 100, oil bushing 128 can be disposed on inner shaft 110 prior to inner shaft 110 being positioned within outer shaft 112. Bushing 128 may be slid longitudinally onto inner shaft 110. Alternatively, the open side of the generally "C"-shaped bushing 128 may be held adjacent to inner shaft 110 as shown in FIG. 5A, and bushing 128 may be pressed radially toward inner shaft 110 and into place, e.g., as shown in FIG. 5B. Bushing 128 may have a resilience sufficient to allow it to temporarily expand a satisfactory amount to allow an open portion of the bushing 128 to fit radially over the diameter of inner shaft 110, and which will allow the bushing 128 to return to its original orientation once in place on inner shaft 110.

Figure 5C:
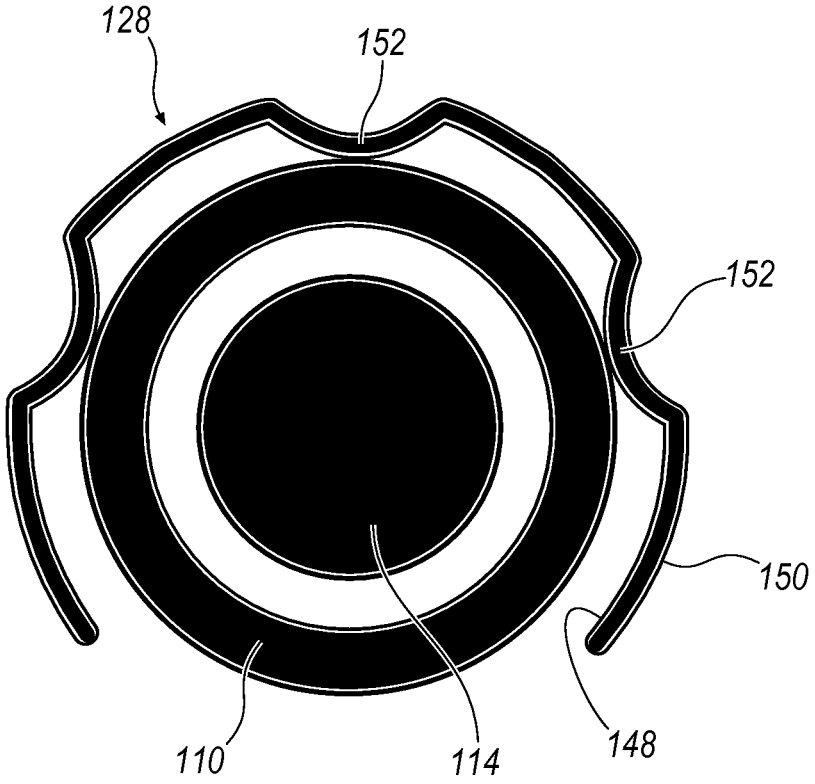
FIG. 5C illustrates the bushing of FIG. 1A in place on the inner shaft of a camshaft assembly, and compressed against the inner shaft of the camshaft assembly in preparation for insertion into the outer shaft of the camshaft assembly.

In preparation for inserting inner shaft 110 into the cylindrical opening defined by the inner diameter of outer shaft 112, bushing 128 may be compressed so at least one portion of inner surface 148 of bushing 128 abuts the outer diameter of inner shaft 110, as shown in FIG. 5C. Compressing bushing 128 around inner shaft 110 may better allow it to fit within annular cavity 142 defined between inner shaft 110 and outer shaft 112. Once bushing 128 is in place on inner shaft 110 and compressed against inner shaft 110, inner shaft 110 can be inserted into a cylindrical opening defined by outer shaft 112. Once bushing 128 is at least partially in place, compression of bushing 128 can be released, allowing outer surface 150 of bushing 128 to press against the inner diameter of outer shaft 112, while a portion of inner surface 148 associated with each of the at least one grooves 152 may abut the outer diameter of inner shaft 110. When bushing 128 is completely in place, one of the at least one grooves 152 may extend a sufficient distance to fluidly connect fluid passage 156 and passageway 158, thereby fluidly connecting cylinder head assembly 118 with reservoir 132 adjacent locking pin 130.

Figure 6:
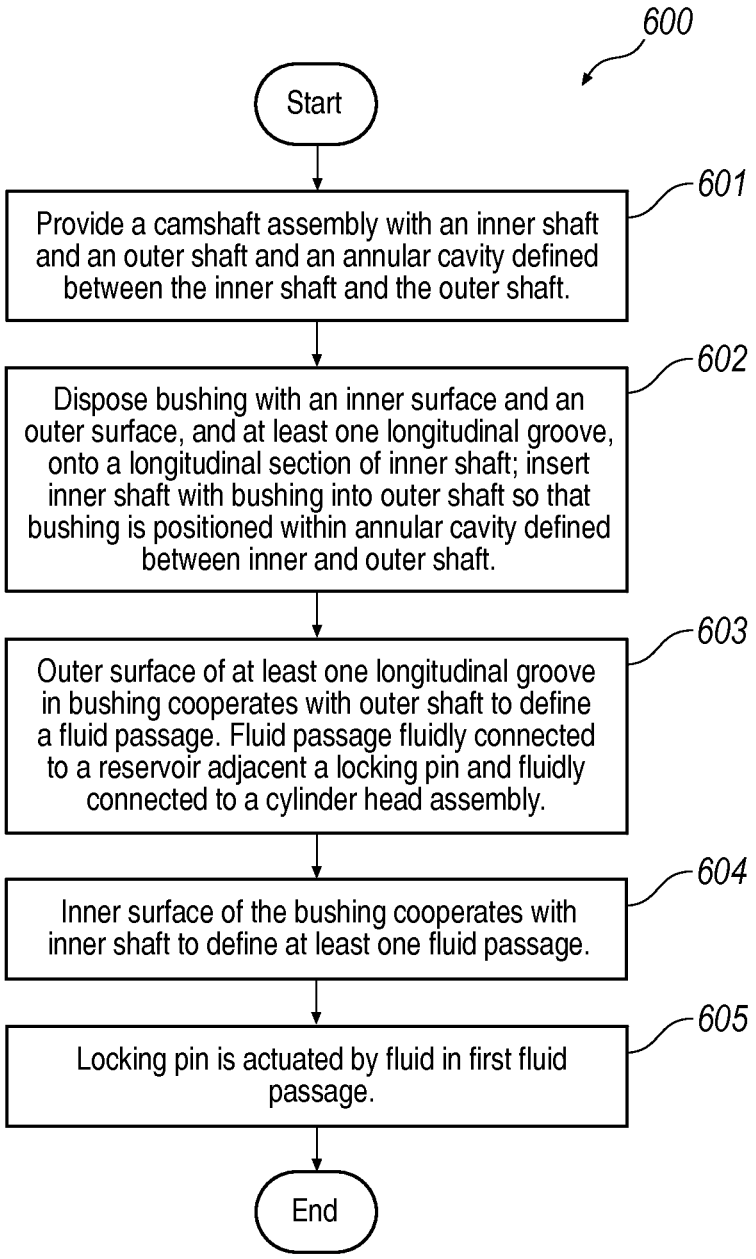
FIG. 6 illustrates an exemplary method for the oil bushing of FIG. 1A.

FIG. 6 is a flowchart illustrating an exemplary method, e.g., of making a bushing. In some exemplary illustrations, a bushing may be employed to define a portion of a fluid passage in a camshaft assembly. Process 600 may begin at block 601, where a camshaft with an inner shaft and an outer shaft and an annular cavity defined between the inner shaft and the outer shaft is provided. The inner shaft and the outer shaft may each define at least one lobe, and may be selectively rotatable with respect to one another.

Proceeding to block 602, a bushing with at least one longitudinal groove may be disposed on the inner shaft. The at least one longitudinal groove of the bushing does not extend to either end of the bushing, but ends a distance from the ends of the bushing. The bushing may have an inner surface and an outer surface, and may be generally "C" shaped. The bushing may be of a resilient material and may be inserted on a longitudinal section of the inner shaft, and the inner shaft with the bushing may be inserted into the outer shaft. The bushing may need to be compressed toward the inner shaft in order to fit into the annular cavity defined between the inner shaft and the outer shaft. The at least one longitudinal groove in the bushing has an outer surface that coincides with the outer surface of the bushing, and an inner surface that coincides with the inner surface of the bushing. Process 600 may then proceed to block 603.

At block 603, the outer surface of the at least one longitudinal groove in the bushing cooperates with the inner diameter of the outer shaft to define a first fluid passage. The fluid passage is fluidly connected to a reservoir adjacent to a locking pin, and fluidly connected to a cylinder head assembly. The fluid passage may thereby allow a locking pin to be fluidly connected to a cylinder head assembly.

Proceeding to block 604, the inner surface of the bushing cooperates with the inner shaft to define at least one fluid passage. Hydraulic fluid or oil within the second fluid passage or passages may allow the inner shaft to be positioned relative to the outer shaft in either an advanced or a retarded position. Finally, in block 605, the locking pin is actuated by the fluid in the passage defined by the outer surface of the at least one longitudinal groove of the bushing and the outer shaft. The locking pin functions to lock the inner shaft in a relative position with respect to the outer shaft.

Using an oil bushing with at least one longitudinal groove that defines a portion of the oil passage leading from the crank shaft to the reservoir adjacent the locking pin allows for ease of manufacturing when compared to manufacturing a passage for the hydraulic operation of the locking pin within the journal bearing and the camshaft. This, in turn, may reduce manufacturing costs, as there may be less machining involved in the production of the camshaft assembly. There may also be fewer manufacturing steps. Using a bushing with at least one longitudinal groove may also reduce the time required to manufacture the camshaft assembly.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain exemplary illustrations, and should in no way be construed so as to limit the claimed invention.

Accordingly, it is to be understood that the above description is intended to be illustrative and not restrictive. Many examples and applications other than the examples provided would be upon reading the above description. It is anticipated and intended that future developments will occur in the arts discussed herein, and that the disclosed systems and methods will be incorporated into such future embodiments. In sum, it should be understood that the invention is capable of modification and variation.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A camshaft assembly, comprising:

an outer shaft;

an inner shaft received within the outer shaft; and a bushing disposed about the inner shaft, the bushing having an outer surface defining at least one longitudinal groove extending at least partially along a length of the bushing, the bushing extending about only a portion of a circumference of the inner shaft such that the bushing is configured to be assembled radially with respect to the inner shaft;

wherein the longitudinal groove cooperates with the outer shaft to define a fluid passage.

2. The camshaft assembly of claim 1, wherein the bushing has an inner surface, wherein the inner surface of the bushing cooperates with the inner shaft to define a cavity configured to allow fluid flow along the inner surface of the bushing.

3. The camshaft assembly of claim 1, wherein the bushing has a first end and a second end, wherein the at least one longitudinal groove has a first end and a second end, the first end of the groove spaced longitudinally away from the first end of the bushing, the second end of the groove spaced longitudinally away from the second end of the bushing.

4. The camshaft assembly of claim 1, wherein the groove defines a depth along an intermediate portion disposed between opposing ends of the groove, wherein at least one of the ends defines a transitional surface between the outer surface of the bushing and the intermediate portion of the groove.

5. The camshaft assembly of claim 4, wherein the transitional surface defines an inclined surface extending from the depth of the intermediate portion to the outer surface of the bushing.

6. The camshaft assembly of claim 1, wherein the fluid passage is in fluid communication with a reservoir configured to actuate a locking pin.

7. The camshaft assembly of claim 6, wherein the locking pin is configured to lock the inner shaft and the outer shaft together to prevent relative rotation between the inner and outer shafts.

8. The camshaft assembly of claim 6, further comprising a journal bearing rotatably supporting a longitudinal portion of the outer shaft, wherein the journal bearing defines in part a fluid pathway, the fluid pathway in fluid communication with the fluid passage defined by the groove.

9. The camshaft assembly of claim 8, further comprising a cylinder head assembly, wherein the outer shaft defines a portion of the fluid pathway, and wherein the portion of the fluid pathway defined by the outer shaft extends radially through the outer shaft, and wherein the portion of the fluid pathway defined by the outer shaft is in fluid communication with the cylinder head assembly.

10. The camshaft assembly of claim 9, wherein the reservoir adjacent the locking pin is in fluid communication with the cylinder head assembly through the fluid passage defined by the at least one groove.

11. The camshaft assembly of claim 9, further comprising at least one seal ring disposed on the journal bearing, wherein the at least one seal ring further defines the fluid passage.

12. The camshaft assembly of claim 1, wherein the bushing is generally "C" shaped.

13. The camshaft assembly of claim 12, wherein the "C" shape of the bushing defines a circumferential extent of the bushing about the portion of the inner shaft.

14. The camshaft assembly of claim 1, wherein the bushing is of a resilient material.

15. The camshaft assembly of claim 14, wherein the resilient material is configured to allow the bushing to deflect upon radial assembly of the bushing to the inner shaft.

16. The camshaft assembly of claim 1, wherein the bushing has a thickness, and wherein the thickness of the bushing is less than a radial distance between an outer diameter of the inner shaft and an inner diameter of the outer shaft.

17. The camshaft assembly of claim 1, wherein the bushing defines an opening extending longitudinally along an entire length of the bushing, the opening configured to receive the inner shaft radially with respect to the inner shaft and the bushing.

18. A camshaft assembly, comprising:

an outer shaft;

an inner shaft received within the outer shaft; and a bushing disposed about the inner shaft, the bushing having an outer surface defining at least one longitudinal groove extending at least partially along a length of the bushing, the bushing extending about only a portion of a circumference of the inner shaft such that the bushing is configured to be assembled radially with respect to the inner shaft, the bushing defining an opening extending longitudinally along an entire length of the bushing, the opening configured to receive the inner shaft radially with respect to the inner shaft and the bushing;

wherein the longitudinal groove cooperates with the outer shaft to define a fluid passage.

19. The camshaft assembly of claim 18, wherein the resilient material is configured to allow the bushing to deflect upon radial assembly of the bushing to the inner shaft.

* * * * *